US005722660A

United States Patent [19]

Rudell et al.

[11] Patent Number: 5,722,660

[45] Date of Patent: Mar. 3, 1998

[54] GAME WITH TIMED WATER RELEASE

[75] Inventors: Elliot Rudell, Torrance; Joseph Cernansky, Palos Verdes Estates, both of Calif.

[73] Assignee: Elliot A. Rudell, Torrance, Calif.

[21] Appl. No.: 790,728

[22] Filed: Jan. 27, 1997

[51] Int. Cl.[6] ..... A63F 3/00

[52] U.S. Cl. ..... 273/287; 273/432; 273/148 R

[58] Field of Search ..... 273/243, 148 R, 273/287, 429, 430, 431, 432

[56] References Cited

U.S. PATENT DOCUMENTS

| | | | |
|---|---|---|---|
| 4,113,259 | 9/1978 | Sands . | |
| 4,526,366 | 7/1985 | Kenoun . | |
| 4,813,680 | 3/1989 | Rudell et al. . | |
| 4,890,838 | 1/1990 | Rudell et al. . | |
| 4,991,847 | 2/1991 | Rudell et al. . | |
| 5,230,517 | 7/1993 | Peacock | 273/432 |
| 5,263,714 | 11/1993 | Rudell et al. . | |
| 5,429,369 | 7/1995 | Hurst | 273/243 |

*Primary Examiner*—William M. Pierce

*Attorney, Agent, or Firm*—Blakely Sokoloff Taylor & Zafman

[57] ABSTRACT

A game wherein a player is squirted with water if the player does not correctly answer a question within a time interval. The game includes a plurality of cards that each have at least one question and a spray unit which has a manually activated resettable timer assembly. The timer assembly releases a fluid from the spray unit if not reset within a time interval. To play the game, the timer assembly is activated and a player is asked a question provided by a card. If the player answers the question correctly the timer is reset and the question is provided to another player. If the player does not answer the question correctly within the time interval the spray device squirts fluid onto the player. The player must then take the card, select a new card and repeat the process of setting the timer and asking other players a question from the newly selected card. This process is repeated until the players hold all of the cards. The player with the least amount of cards wins the game.

8 Claims, 1 Drawing Sheet

GAME WITH TIMED WATER RELEASE

BACKGROUND OF THE INVENTION

1. Field of the Invention

The present invention relates to a game wherein a player is squirted with water if the player does not correctly answer a question within a time interval.

2. Description of Related Art

There have been developed a number of social activity games which require group participation. For example, there has been marketed a game under the trademark TRIVIAL PURSUIT wherein a player or team of players must correctly answer questions to move a token about a board.

U.S. Pat. No. 5,429,369 issued to Hurst discloses a game board which has a water spray device that is attached to the board. The game requires that a player correctly answer a question printed on a card provided with the game. Another player may actuate a pump and spray the player with the spray device if the player provides an incorrect answer.

U.S. Pat. No. 4,113,259 issued to Sands is a game board which also has a water spray device. The players take turns moving a token across the game board in accordance with instructions provided by a spinning dial. When a player reaches a certain position on the board, the player can actuate the spray device to spray another player.

U.S. Pat. No. 4,526,366 issued to Kenoun discloses an electronic water game that contains a turret which pivots about a stationary base. Each player position of the turret has a nozzle, a light and a switch. The switches are manipulated to spray water onto the other players, and to block water from being sprayed onto the player.

U.S. Pat. Nos. 4,890,838 and 4,991,847 issued to Rudell disclose a time released water toy. The Rudell toy includes two molded shells that form a foraminous ball that is assembled over a water filled balloon. Players pass the balloon filled ball to each other. The ball also contains an internal resettable timer that punctures the balloon when the timer times out. Puncturing the balloon releases water onto the player holding the ball.

U.S. Pat. Nos. 4,813,680 and 5,263,714 issued to Rudell disclose water release games which have members that can be selected to release or prevent the release of water.

SUMMARY OF THE INVENTION

The present invention is a game wherein a player is squirted with water if the player does not correctly answer a question within a time interval. The game includes a plurality of cards that each have at least one question and a spray unit which has a manually activated resettable timer assembly. The timer assembly releases a fluid from the spray unit if not reset within a time interval. To play the game, the timer assembly is activated and a player is asked a question provided by a card. If the player answers the question correctly the timer is reset and the question is provided to another player. If the player does not answer the question correctly within the time interval the spray device squirts fluid onto the player. The player must then take the card, select a new card and repeat the process of setting the timer and asking other players a question from the newly selected card. This process is repeated until the players hold all of the cards. The player with the least amount of cards wins the game.

DETAILED DESCRIPTION OF THE INVENTION

Figure 1:
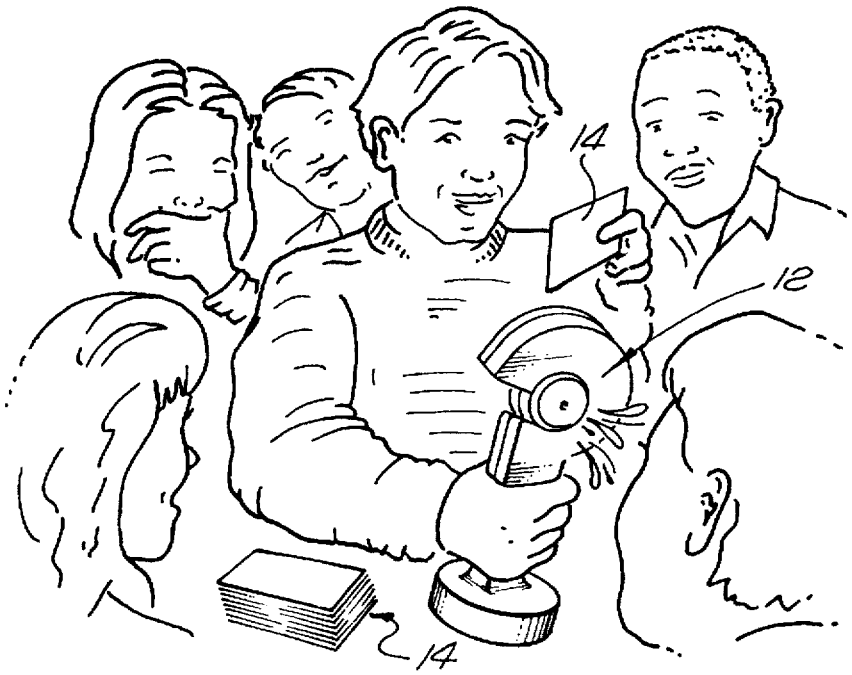
FIG. 1 is a perspective view showing a number of players performing the game of the present invention.

Referring to the drawings more particularly by reference numbers, FIG. 1 shows a game 10 of the present invention. The game 10 includes a spray unit 12 and a deck of cards 14. Each card 14 has at least one question that can be provided to the other players in accordance with the game method of the present invention. In the preferred embodiment there are 52 cards in a deck. The spray unit 12 includes a manually activated resettable timer assembly that releases water onto a player when activated and not reset within a time interval.

To play the game the spray unit 12 is filled with a fluid such as water and the players form a circle about a "question" player. The question player selects one card 14 from the deck of cards. The question player then activates the timer of the spray unit 12 and ask one of the players a question from the selected card 14. The player then attempts to correctly answer the question. If the player provides a correct response within the time interval the question player resets the timer and ask the next player the question. If the player does not provide a correct response within the time interval the spray unit 12 releases the water. The question player holds the spray unit 12 adjacent to the player so that the water is sprayed onto the player as a penalty for not correctly responding to the question.

After being sprayed, the sprayed player takes the card and moves to the center of the circle to become the new question player. The old question player then becomes a participant who answers questions. The new question player selects a card 14 from the deck, sets the timer and provides a question to one of the players. The player must correctly answer the question or be squirted with water.

Correctly answering a question moves the question to an adjacent player in the circle. The subsequent players cannot use an answer of a previous player. For example, if the question is to name a professional baseball team and the first player correctly responds "Los Angeles Dodgers", the next player must name a team other than the Dodgers. If all of the players provide a correct answer within the time interval a new card is selected and the process is repeated. Each time a player does not provide a correct answer within the time interval the player is squirted and must hold the selected card. The game is played until all of the cards are removed from the deck and held by the players. The player with the least amount of cards wins the game.

If two or more people have the lowest number of cards, an elimination round is performed to determine a winner. The players with the lowest number of cards sit in a circle and a designated question player selects a card, sets the timer assembly and provides a question for the players. A player who does not correctly answer the question within the time interval is eliminated from the game. This process continues until only one player remains. The remaining player wins the game.

Two or more players may state that the question is too hard and request a new question. Additionally, the question player can challenge the correctness of an answer. The player can respond with a new correct answer before the timer times out. If the timer expires before a correct response is provided and the player subsequently proves that the challenged answer is correct, the sprayed player become the new question player, but the question player that challenged the question must take the card.

Figure 2:
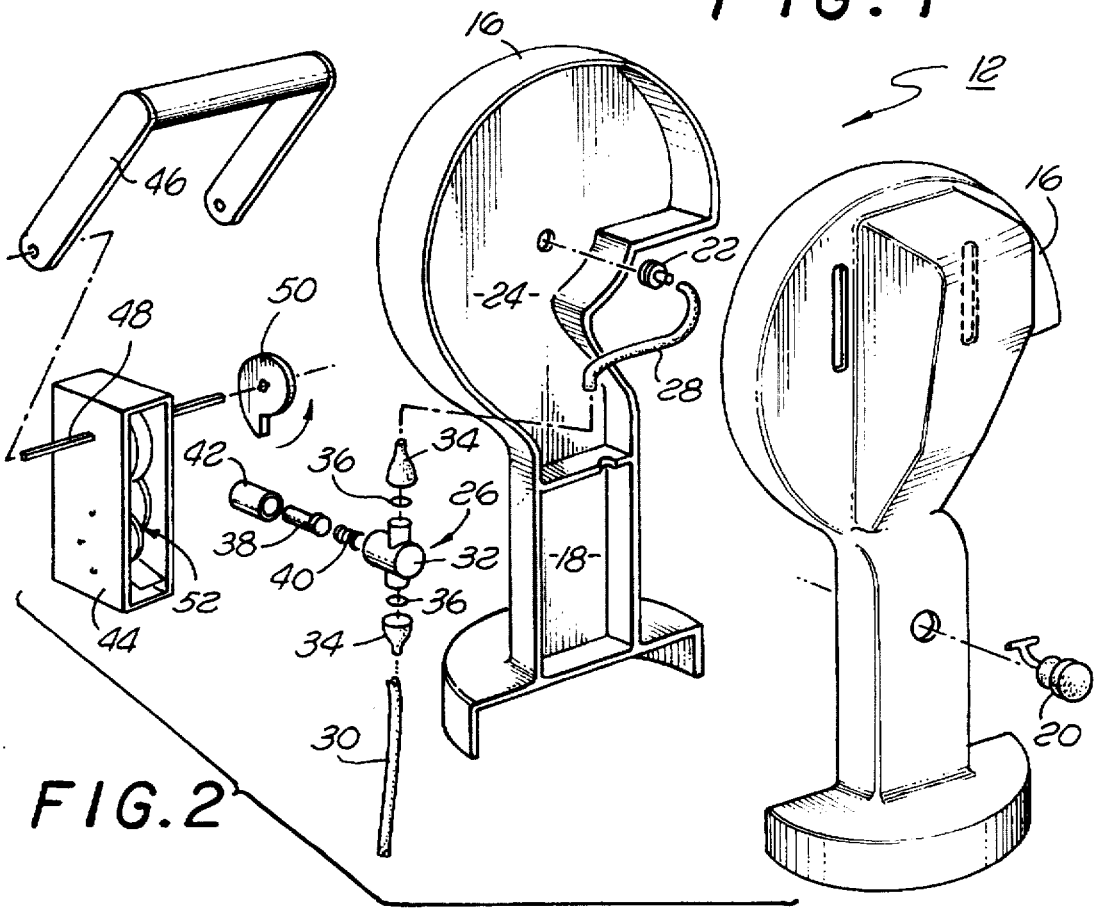
FIG. 2 is an exploded view of a spray unit of the game.

FIG. 2 shows a spray unit 12. The unit 12 includes a housing 16 that is preferably constructed from two molded pieces. The spray unit 12 is light and portable so that the unit 12 can be held by a child. The housing 16 includes a reservoir 18 that can be filled with water through a fill plug 20.

The spray unit 12 has a nozzle 22 attached to the housing 16 in an upper chamber 24. The nozzle 22 is coupled to the reservoir 18 by a pump assembly 26 and a pair of tubes 28 and 30. The pump assembly 26 includes a pump chamber 32 that is connected to the tubes 28 and 30 by a pair of adapters 34 and seals 36. Located within the pump chamber 32 is a piston 38 and a return spring 40. The piston 38 is captured by a sleeve 42. Movement of the piston 38 pushes water within the pump chamber 32 through the nozzle 22. The pump chamber 32 preferably contains a pair of one-way check valves to prevent the water within the pump chamber 32 from being pushed back into the reservoir 18.

Also located within the upper chamber 24 is a gear driven timer 44 that is activated by rotating a handle 46. The handle 46 is coupled to the timer 44 by a shaft 48. The shaft 48 is also connected to a cam 50. When the timer 44 is activated by rotation of the handle 46 the internal timer gears 52 move while the shaft 48 remains stationary. After a certain timer interval the timer gears reach a position wherein the shaft 48 and cam 50 are rotated in a counterclockwise direction. Rotation of the cam 50 pushes the piston 38 and squirts water from the nozzle 22 of the unit. The spray unit 12 can be reset by rotating the handle 46. Rotating the handle 46 before the time interval prevents water from being released from the unit 12.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. For example, instead of a mechanical timer the spray unit may incorporate an electrical timer that is activated by a button. The timer may be connected to a sound device and light emitting diodes (LEDs) which emit sounds and light that provide an indication of the countdown of the timer.

What is claimed is:

1. A method for playing a game, comprising the steps of:

a) providing a spray unit which has a manually activated resettable timer assembly that actuates a valve which releases a fluid if said spray unit is not reset within a time interval;

b) activating said resettable timer assembly;

c) providing a question to a first player;

d) responding to the question; and, e) resetting said resettable timer assembly if the response is correct, wherein said resettable timer assembly will automatically release the fluid onto the first player if the first player does not provide a correct response within the time interval.

2. The method as recited in claim 1, further comprising the steps of providing the first player with a card that contains the question and repeating steps (b)–(e) with a second player if the first player did not provide a correct response.

3. The method as recited in claim 1, further comprising the step of repeating steps (b)–(e) with a second player if the first player provides a correct response.

4. The method as recited in claim 2, wherein the first player provides the question to the second player.

5. The method as recited in claim 3, further comprising the steps of providing a number of cards and repeating steps (b)–(e) with the players until the players hold all of the cards, wherein the player with the least number of cards wins the game.

6. A game set, comprising:

a spray unit which has a manually activated resettable timer assembly that actuates a valve which releases a fluid if said spray unit is not reset within a time interval; and, a plurality of cards that each contain at least one question which must be correctly answered by a player within the time interval, wherein the fluid is automatically released onto the player if the player does not provide a correct answer within the time interval.

7. The game set as recited in claim 6, wherein said spray unit includes a reservoir of fluid.

8. The game set as recited in claim 6, wherein said spray unit has a handle that activates said resettable timer assembly.

* * * * *